US007707698B2

(12) United States Patent
Gardner

(10) Patent No.: US 7,707,698 B2
(45) Date of Patent: May 4, 2010

(54) ADJUSTABLE FASTENER FOR CLOTHING

(75) Inventor: James Gardner, Goldens Bridge, NY (US)

(73) Assignee: Multi-Adjustable Closure Corporation, Goldens Bridge, NY (US)

( * ) Notice: Subject to any disclaimer, the term of this patent is extended or adjusted under 35 U.S.C. 154(b) by 508 days.

(21) Appl. No.: 11/809,601

(22) Filed: Jun. 1, 2007

(65) Prior Publication Data

US 2008/0295304 A1 Dec. 4, 2008

(51) Int. Cl.
*A41C 3/00* (2006.01)
*A44B 13/00* (2006.01)

(52) U.S. Cl. ..... 24/697.1; 24/697.2; 24/580.11; 24/578.11; 24/578.13; 24/590.1; 24/595.1; 24/DIG. 51; 450/82; 450/1; 450/25; 2/336; 2/265

(58) Field of Classification Search ..... None
See application file for complete search history.

(56) References Cited

U.S. PATENT DOCUMENTS

| | | | | |
|---|---|---|---|---|
| 637,286 | A * | 11/1899 | Robin | 24/580.11 |
| 886,894 | A | 5/1908 | Thompson et al. | |
| 1,305,073 | A | 5/1919 | Decker | |
| 1,412,033 | A | 4/1922 | Able | |
| 1,709,181 | A * | 4/1929 | Matlock | 24/595.1 |
| 1,854,125 | A | 4/1932 | Faber | |
| 2,040,046 | A | 5/1936 | Grosebeck | |
| 2,105,333 | A * | 1/1938 | Roseman | 24/695 |
| 2,423,046 | A | 6/1947 | Patterson | |
| 2,653,323 | A | 9/1953 | Ganim | |
| 2,657,392 | A | 11/1953 | Jackson | |
| 2,753,569 | A | 7/1956 | Schmalz | |
| 3,484,907 | A | 12/1969 | Elsenheimer | |
| 6,253,428 | B1 | 7/2001 | Wang | |
| 6,309,489 | B1 | 10/2001 | Fildan et al. | |
| 6,321,419 | B1 | 11/2001 | Fildan et al. | |
| 6,536,085 | B1 | 3/2003 | Milano | |

FOREIGN PATENT DOCUMENTS

| | | |
|---|---|---|
| AU | 442121 B | 10/1973 |
| CA | 1199753 | 1/1968 |
| DE | 2606576 | 2/1976 |
| EP | 0084747 | 11/1982 |

* cited by examiner

*Primary Examiner*—Jack W. Lavinder
(74) *Attorney, Agent, or Firm*—Galgano & Associates PLLC

(57) ABSTRACT

An adjustable fastener includes a male part and a female part, both of which are preferably made of soft pliable, sewable plastic. The female fastener part preferably has two or more spaced apart openings. Each having a broad portion and a narrow portion. The male fastener part has a base with an upstanding riser with a flange at the end of the riser. The female fastener part is made of a single thin wall which is sewn to the fabric of the garment. The base of the male part is also made of a single thin wall which is sewn to the fabric of the garment. The single wall construction of the female fastener part makes it more flexible, less easily seen, and not felt so much by the wearer. The female fastener part is provided with a bend between the openings so that it lies flat against the back when the male and female parts are coupled to the tightest position. The center of the riser of the male part is offset from the center of the flange. This allows the flange to be made larger and the narrow portion of each opening in the female part to be made smaller.

28 Claims, 8 Drawing Sheets

ADJUSTABLE FASTENER FOR CLOTHING

CROSS-REFERENCE TO RELATED APPLICATIONS

This application is related to co-owned U.S. Pat. No. 6,536,085, the complete disclosure of which is hereby incorporated by reference herein.

BACKGROUND OF THE INVENTION

1. Field of the Invention

The invention relates to fasteners for clothing. More particularly, the invention relates to an adjustable fastener for a brassiere or similar garment.

2. State of the Art

Many articles of clothing are provided with adjustable fasteners. In particular, brassieres are typically provided with an adjustable fastener for connecting right and left center backs of the garment. These fasteners usually include one or more hooks and multiple eyelets spaced apart from each other so that the snugness of the garment eye can be adjusted by mating the hook(s) with the appropriate eyelet(s).

The known brassier fasteners have several disadvantages. First, being located at the back of the garment, they are difficult to manipulate. Second, the hooks and eyelets are typically made of metal and feel uncomfortable pressing against the back of the wearer. Third, the fastener is typically thicker than the garment to which it is attached and is visible through outerwear as a bump.

Many attempts have been made to provide a brassier fastener which is easy to operate, comfortable to the wearer and less visible. While these fasteners may solve some of the problems described above, they typically do not solve all of the problems and often introduce new problems. For example, in attempting to overcome the problems described above, many brassier fasteners sacrifice stability for comfort. This permits the fastener to accidentally detach. Also, some fasteners which attempt to solve the problem of visibility have actually increased the difficulty in operation of the fastener.

The previously incorporated co-owned U.S. patent discloses an adjustable fastener that includes a male part and a female part, both of which are made of soft pliable, sewable plastic. The female fastener part has three spaced apart openings. Each opening has a broad portion and a narrow portion. The male fastener part has a base with an upstanding riser with a flange at the end of the riser. The flange is dimensioned to fit into the broad portion of each opening in the female fastener part and the riser is dimensioned to fit snugly into the narrow portion of each opening in the female fastener part. The back side of the male fastener part is provided with parallel grooves which enhance gripping when releasing the fastener. Both of the fastener parts have a pair of parallel flanges at one end between which the garment back end is inserted and secured to the fastener part. The fastener parts thus become extensions to the garment and are easily visible as such unless covered with additional material. The fastener parts are preferably attached to the garment's center backs or back straps so that the openings in the female fastener part face the back of the wearer and the riser and flange on the male fastener part face away from the back of the wearer. The back of the female fastener part is preferable covered with fabric and/or bears a trademark or a design.

According to one embodiment, the flange on the male fastener part is substantially circular and has a centrally located nub rising from its surface. The broad portion of each opening in the female fastener part is substantially circular and the narrow portion of each opening in the female fastener part has a nub-receiving well. This structure adds stability to the fastener, preventing accidental unfastening.

According to another embodiment, the flange on the male fastener part is substantially elliptical. The broad portion of each opening in the female fastener part is substantially elliptical and a pair of ears extend between the broad portion and the narrow portion of each opening in the female fastener part. This structure also adds stability to the fastener, preventing accidental unfastening.

According to one method of manufacture, both parts are injection molded and are fastened to brassier center backs by sewing. According to another method of manufacture, the male fastener part is injection molded, but the female fastener part is made from a laminate structure which includes two outer layers and two inner layers. The outer layers are made of a soft fabric material and the inner layers are made of soft plastic. One of the plastic layers has the openings as described and the other plastic layer has thick portions which surround the openings in the other plastic layer to create a space for receiving the male fastener part. The plastic spacer is made by embossing a plastic sheet and the outer fabric layers are made from a single layer which is folded.

It has since been discovered that some of the features of the fastener described in the previously incorporated patent are, in fact, disadvantages. For example, the manner in which the fastener parts are attached to the garment is relatively complicated when it is desirable to make the fastener less visible. In addition, while the fastener is made of soft plastic, its presence is still detectable by the wearer on the wearer's back. Furthermore, the overall size of the fastener parts is relatively large making them more easily seen and felt.

SUMMARY OF THE INVENTION

It is therefore an object of the invention to provide an, adjustable fastener for clothing, in particular brassieres.

It is also an object of the invention to provide an adjustable fastener which is easy to operate.

It is another object of the invention to provide an adjustable fastener which is soft and comfortable.

It is still another object of the invention to provide an adjustable fastener which is stable when fastened.

It is yet another object of the invention to provide an adjustable fastener which is concealed when fastened.

In accord with these objects which will be discussed in detail below, the adjustable fastener of the present invention includes a male part and a female part, both of which are preferably made of soft pliable, sewable plastic. The female fastener part has at least one and preferably two or more spaced apart openings. Each opening has a broad portion and a narrow portion. The male fastener part has a base with an upstanding riser with a flange at the end of the riser. The flange is dimensioned to fit into the broad portion of each opening in the female fastener part and the riser is dimensioned to fit snugly into the narrow portion of each opening in the female fastener part. The narrow portion of each opening in the female fastener part is preferably rectilinear in shape and the riser of the male fastener part is also preferably rectilinear in section. Thus, when the riser is in the narrow portion of an opening in the female fastener part, rotation of the male fastener part relative to the female fastener part is restricted.

The female fastener part is advantageously made of a single thin wall which is sewn to the fabric of the garment. The base of the male part is also advantageously made of a single thin wall which is sewn to the fabric of the garment. The fastener parts are preferably attached to the garment's center backs so that the openings in the female fastener part face the back of the wearer and the riser and flange on the male fastener part face away from the back of the wearer. The back of the female fastener part is covered by the garment and does not need to be covered with any other fabric.

According to one aspect of the invention, the single wall construction of the female fastener part makes it more flexible, less easily seen, and not felt so much by the wearer. According to another aspect of the invention, the female fastener part is provided with a bend between the openings so that it lies flat against the back when the male and female parts are coupled to the tightest position. Without the bend, the free end of the female part would rise up away from the back, calling attention to itself from behind the fabric of a blouse.

According to another aspect of the invention, the center of the riser of the male part is offset from the center of the flange. This allows the flange to be made larger and the narrow portion of each opening in the female part to be made smaller. Together these features make the fastener assembly smaller but more stable.

According to a first alternate embodiment, the flange of the male part is provided with a ramp which increases the frictional engagement between the two parts. This is particularly useful for swimwear and activewear with which a more secure coupling of the fastener parts is desirable.

According to a second alternate embodiment the engaging parts of the male and/or the female parts are provided with nubs which increase the frictional engagement of the parts sufficiently that they will not become disengaged while on a hanger in a retail store, or in transit to the retail store.

According to a third alternate embodiment, the male part is provided with a nub and the female part is provided with a bump which the nub passes over when the parts engage. This increases the stability of the fastener and provides a tactile snap or click when the parts are coupled.

According to a fourth alternative embodiment, the male part is provided with a nub and the female part is provided with a groove which the nub seats in when the parts engage. This increases the stability of the fastener and provides a tactile snap or click when the parts are coupled.

Additional objects and advantages of the invention will become apparent to those skilled in the art upon reference to the detailed description taken in conjunction with the provided figures.

Certain of the foregoing and related objects are also attained according to the invention by the provision of an adjustable fastener for an article of clothing, said fastener comprising a) a male part having a base, a riser extending from said base, and a flange extending from the riser, said flange and said base having substantially collinear center lines and said riser having a center line which is laterally offset from said substantially collinear center lines; and b) a female part having a plurality of spaced apart openings, each opening having a broad portion and a narrow portion, wherein said flange is dimensioned to pass through said broad portion but not said narrow portion and said riser is dimensioned to slide into said narrow portion.

Preferably, said female part consists of a single ply of plastic and/or has a center fold. Desirably, said center fold forms an angle of approximately 20 degrees. Advantageously, said broad portion is substantially oblate circular in shape, and said flange is substantially oblate circular in shape and has an inner ramp. Most advantageously, said flange has an inner nub and said female part has a groove adjacent each narrow portion or a bump adjacent each narrow portion. Most preferably, a plurality of said male and female parts are provided.

In a preferred embodiment, an adjustable fastener for an article of clothing comprises: a) a male part having a base, a riser extending from said base, and a flange extending from the riser; and b) a female part having a plurality of spaced apart openings, each opening having a broad portion and a narrow portion, wherein said flange is dimensioned to pass through said broad portion but not said narrow portion and said riser is dimensioned to slide into said narrow portion, where in said female part has a fold between two of said spaced apart openings.

In another preferred embodiment, a brassiere, comprises: a left cup; a right cup coupled to said left cup; a left back strap coupled to said left cup and having a first free end; a right back strap coupled to said right cup and having a second free end; an adjustable fastener having a) a male part having a base, a riser extending from said base, and a flange extending from the riser, said flange and said base having substantially collinear center lines and said riser having a center line which is laterally offset from said substantially collinear center lines, said male part being coupled to one of said first and second free ends; and b) a female part having a plurality of spaced apart openings, each opening having a broad portion and a narrow portion, wherein said flange is dimensioned to pass through said broad portion but not said narrow portion and said riser is dimensioned to slide into said narrow portion, said female part being coupled to the other of said first and second free ends.

Preferably, said male and female parts are coupled to said free ends by stitching. Desirably, said male and female parts are coupled to said free ends such that when the brassiere is worn, said female part faces the back of the wearer and said male part faces away from the back of the wearer. Most advantageously, said female part is a single ply of plastic and said base is a single ply of plastic.

In yet another embodiment, a brassiere, comprises: a left cup; a right cup coupled to said left cup; a left back strap coupled to said left cup and having a first free end; a right back strap coupled to said right cup and having a second free end; an adjustable fastener having a) a male part having a base, a riser extending from said base, and a flange extending from the riser, said male part being coupled to one of said first and second free ends; and b) a female part having a plurality of spaced apart openings, each opening having a broad portion and a narrow portion, wherein said flange is dimensioned to pass through said broad portion but not said narrow portion and said riser is dimensioned to slide into said narrow portion, said female part being coupled to the other of said first and second free ends, and wherein said female part has a fold between two of said spaced apart openings.

Preferably, said fold defines an angle of approximately 20 degrees. Advantageously, said female part is arranged such that, when said brassiere is worn, said fold forms a concavity that faces the wearer's back. Desirably, a plurality of said male parts are provided.

DETAILED DESCRIPTION

Figure 1:
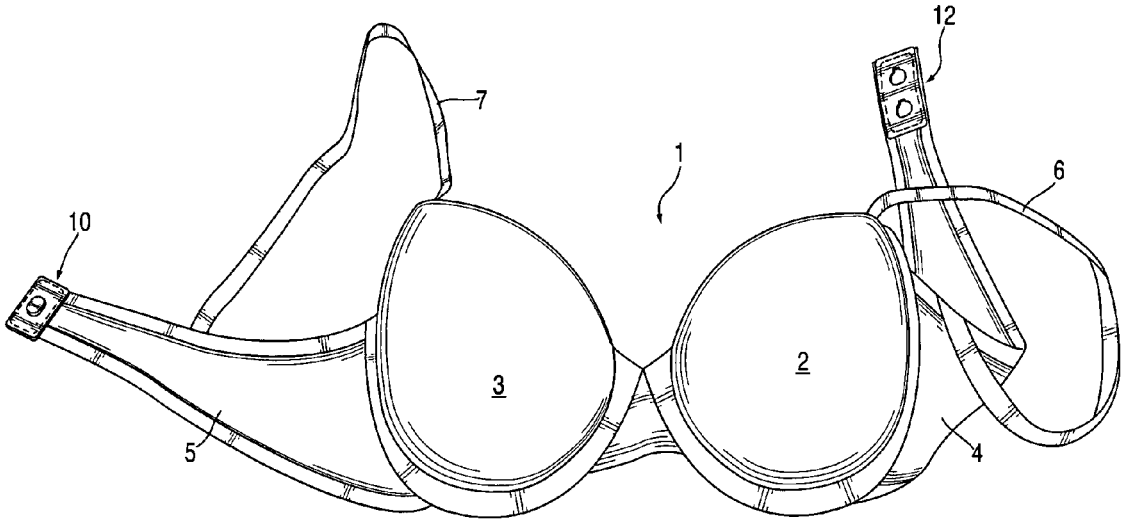
FIG. 1 is a perspective front view of an article of clothing, i.e. a brassiere, incorporating a fastener according to the invention.
Figure 2:
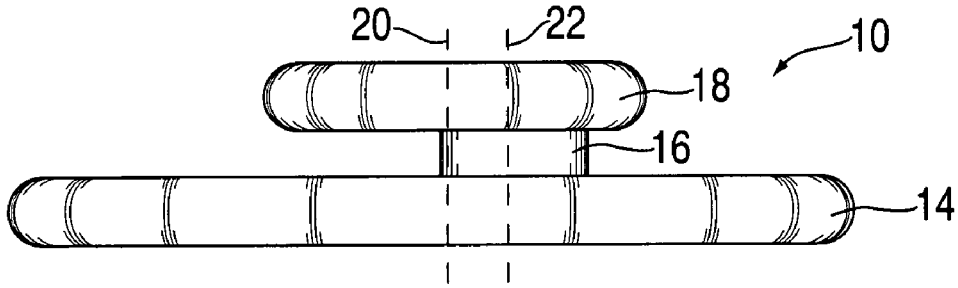
FIG. 2 is a side elevation view of a first embodiment of a male fastener part.

Turning now to FIG. 1, a brassiere 1 is shown with an adjustable fastener according to the invention. The brassiere 1 includes left and right cups 2, 3. Left and right back straps 4, 5 extend horizontally from the cups 2, 3. Left and right shoulder straps 6 and 7 extend vertically upward from the cups 2, 3 and extend down to the back straps 4, 5. The fastener of the present invention includes a male part 10 and a female part 12. As seen in FIG. 1, the parts are preferably sewed directly to the fabric of the back straps 4, 5 and the openings in the female fastener part 12 preferably face the back of the wearer and the male fastener part 10 preferably faces away from the back of the wearer although this could be reversed. Due to the fact that the female fastener preferably overlies the end portion of the bra strap, rather than extending from it as in the '085 patent, the back of the female fastener part (not shown) is covered by the garment and does not need to be covered with any other fabric.

Figure 5:
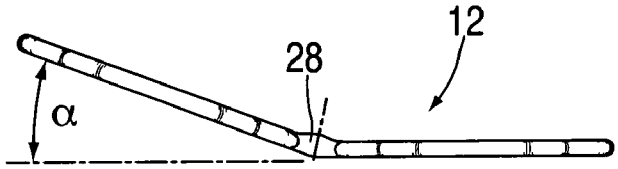
FIG. 5 is a side elevation view of the female fastener part of FIG. 4.
Figure 3:
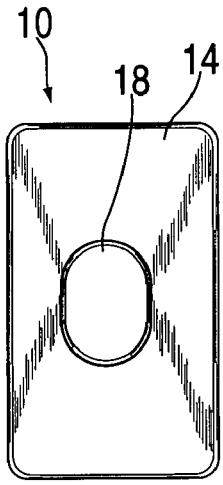
FIG. 3 is a top plan view of the male fastener part of FIG. 2.
Figure 6:
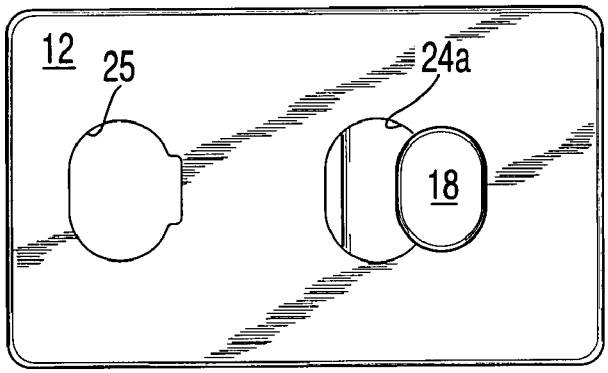
FIG. 6 is a bottom plan view of the female fastener part of FIGS. 4 and 5 coupled to the male fastener part of FIGS. 2 and 3.
Figure 7:
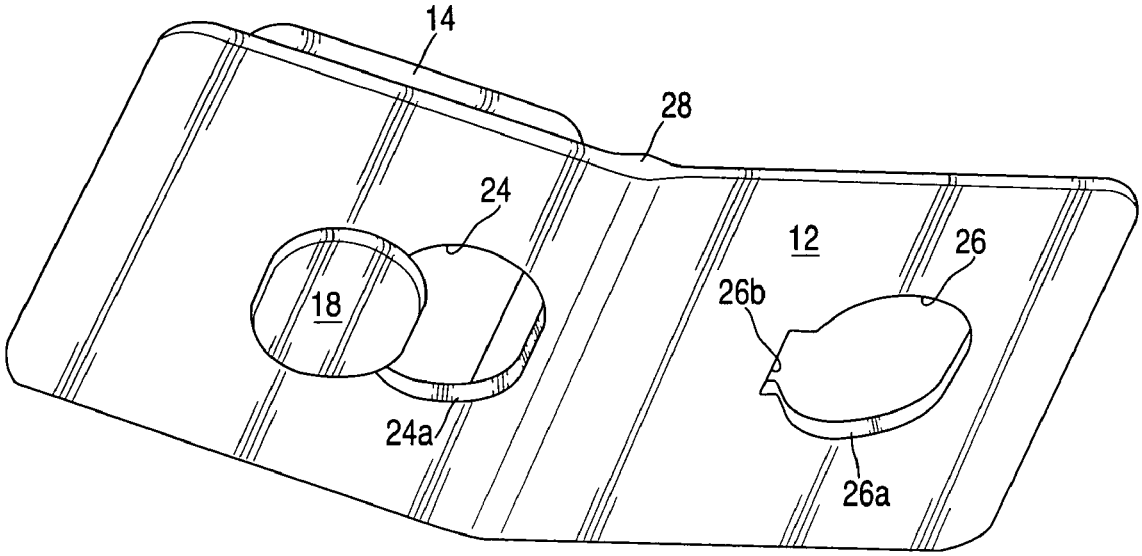
FIG. 7 is a perspective view of the first embodiment of the male fastener part coupled to the first embodiment of the female fastener part.
Figure 8:
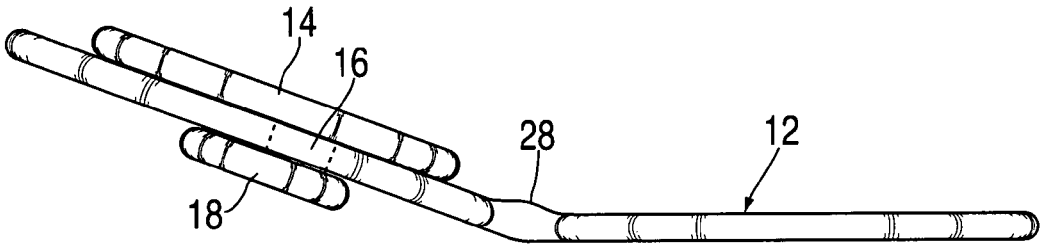
FIG. 8 is a side elevation view of the first embodiment of the male fastener part coupled to the first embodiment of the female fastener part.

FIGS. 2-8 illustrate a first embodiment of the fastener in more detail. The male fastener part 10 has a base 14 with an upstanding riser 16 with a flange 18 at the end of the riser 16. As seen best in FIG. 2, the base 14 and the flange 18 share a collinear centerline 20. The riser 16 has a centerline 22 which is offset from the centerline 20. This allows more area of the flange to engage the surface of female fastener part 12 as seen in FIGS. 6-8.

Figure 4:
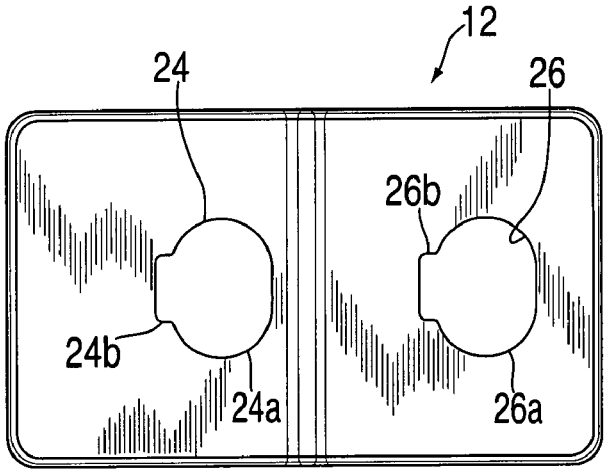
FIG. 4 is a top plan view of a first embodiment of a female fastener part.

Referring now to FIGS. 4 and 5, the female fastener part 12 has at least one and preferably two or more spaced apart openings 24, 26. Each opening has a broad portion 24*a*, 26*a* and a narrow portion 24*b*, 26*b*. The broad portion 24*a*, 26*a* has the shape of an oblate circle and as can be see from FIGS. 3 and 6, the flange 18 of the male fastener part 10 also has the shape of an oblate circle. According to the presently preferred embodiments, the fastener parts have the following approximate dimensions: The flange 18 of the male fastener part 10 is dimensioned at 0.357 inch by 0.271 inch. The thickness of the base. 14 and the thickness of the flange 18 is 0.047 inch which is also the height of the riser 16. The base 14 has overall dimensions of 1 inch by 0.6 inch. The openings 24, 26 of the female fastener part 12 are dimensioned at 0.392 inch by 0.335 inch (includes both the broad and the narrow portion). The width of the narrow portion 24*b*, 26*b* is 0.1875 inch and the width of the riser 16 of the male fastener part 10 is 0.187. The space between the edges of the openings 24, 26 is 0.415 inch and the overall dimensions of the female fastener part is 1 inch by 1.687 inches. As seen best in FIG. 5, the female fastener part 12 has a bend 28 at its center that forms an angle [alpha] of approximately 20 degrees. As shown in FIG. 1, the female fastener part 12 is attached to the garment so that the bend forms a concavity that faces the back of the wearer. The bend between causes the female fastener part 12 to lie flat against the back when the male and female parts are coupled to the tightest position. Without the bend, the free end of the female part would rise up away from the back, calling attention to itself from behind the fabric of a blouse.

Figure 9:
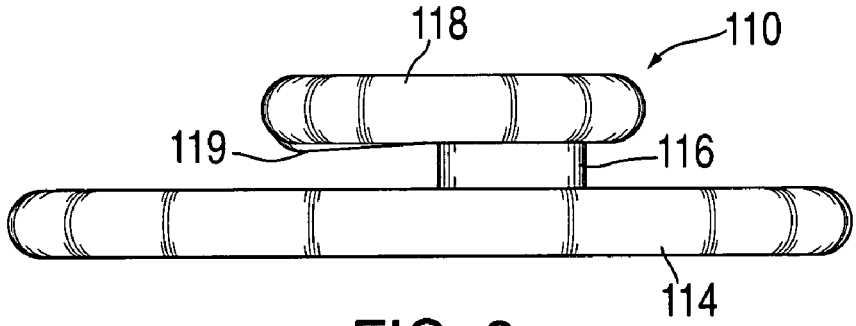
FIG. 9 is a side elevation view of a second embodiment of a male fastener part.
Figure 10:
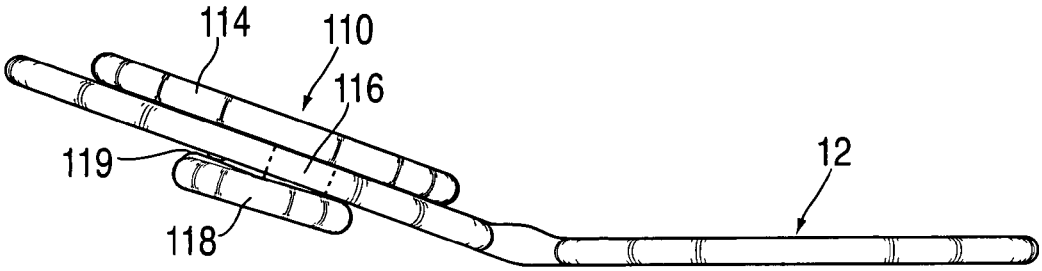
FIG. 10 is a side elevation view of the second embodiment of the male fastener part coupled to the first embodiment of the female fastener part.

FIGS. 9 and 10 show a first alternate embodiment of the invention which utilizes the same female part 12 and a slightly modified male part 110. The male fastener part 110 has a base 114 and a riser 116 which are substantially identical to the base 14 and riser 16 of the part 10. The flange 118, however, is provided with a wedge-shaped ramp 119 which increases the frictional engagement between the two parts 12 and 110 as shown in FIG. 10. This is particularly useful for swimwear and activewear with which a more secure coupling of the fastener parts is desirable.

Figure 11:
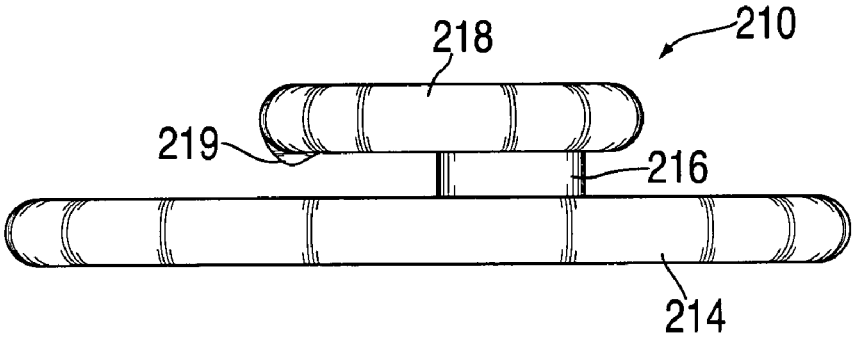
FIG. 11 is a side elevation view of a third embodiment of a male fastener part.
Figure 13:
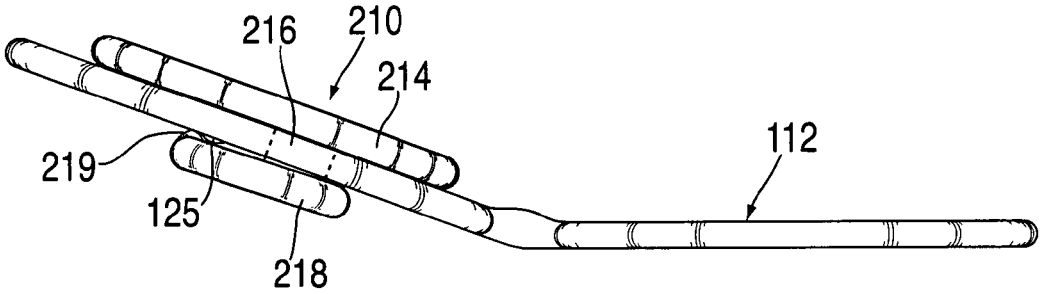
FIG. 13 is a side elevation view of the third embodiment of the male fastener part coupled to the second embodiment of the female fastener part.
Figure 15:
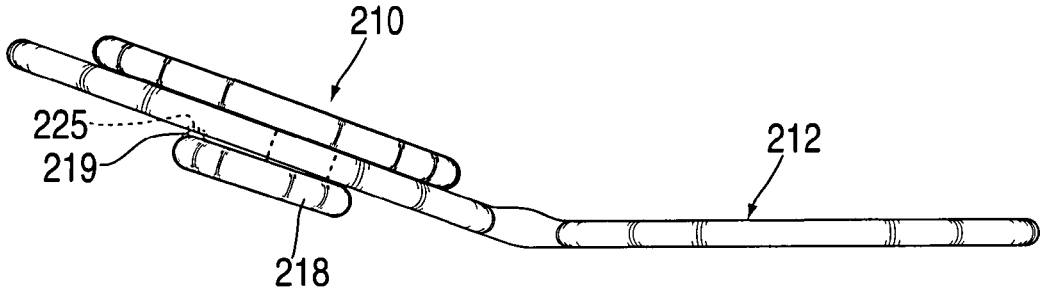
FIG. 15 is a side elevation view of the third embodiment of the male fastener part coupled to the third embodiment of the female fastener part.
Figure 12:
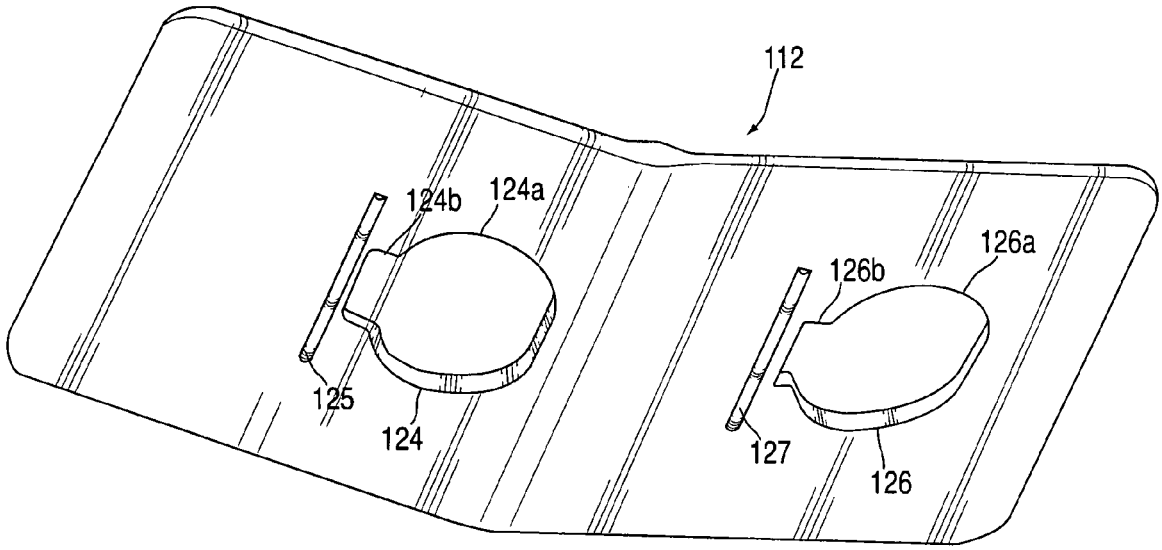
FIG. 12 is a perspective view of the second embodiment of the female fastener part.
Figure 14:
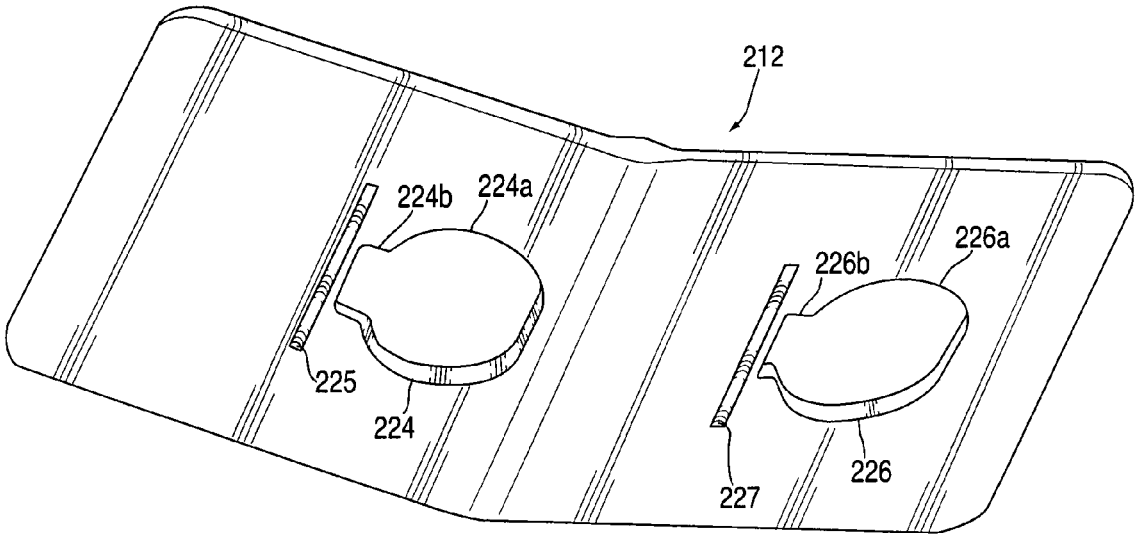
FIG. 14 is a perspective view of the third embodiment of the female fastener part.

FIGS. 11-13 illustrate a second alternate embodiment where both the male fastener part 210 and the female fastener part 112 have been modified. The male fastener part 210 has a base 214 and a riser 216 which are substantially identical to the base 14 and riser 16 described above. According to this embodiment, the flange 218 is provided with a nub 219. As shown in FIG. 12, the female part 112 is provided with two bumps 125, 127, each arranged adjacent to the narrow part 124*b*, 126*b* of the respective openings 124, 126. Though the bumps 125, 127 have been illustrated as having substantially the same or greater width as the openings 124*a*, 126*a*, they could be made narrower and be more in the nature of a nub. This type of arrangement increases the frictional engagement of the parts sufficiently that they will not become disengaged while on a hanger in a retail store, or in transit to the retail store. As the parts are coupled, the nub 219 passes over the bump 125 or 127. This also provides a tactile snap or click when the parts are coupled FIGS. 14 and 15 illustrate a third alternate embodiment. In this embodiment, the male fastener part 210 is the same as in the previous embodiment. According to this embodiment, the female fastener part 212 is provided with two grooves 225, 227 each arranged adjacent to the narrow part 224*b*, 226*b* of the respective openings 224, 226. The grooves are preferably as wide as the openings 224*a*, 226*a*, but at least as wide as the nub 219 on the flange 218 of the male part 210. When the parts are coupled together, the nub 219 snaps into the groove 225 or 227 This increases the stability of the fastener and provides a tactile snap or click when the parts are coupled.

Figure 16:
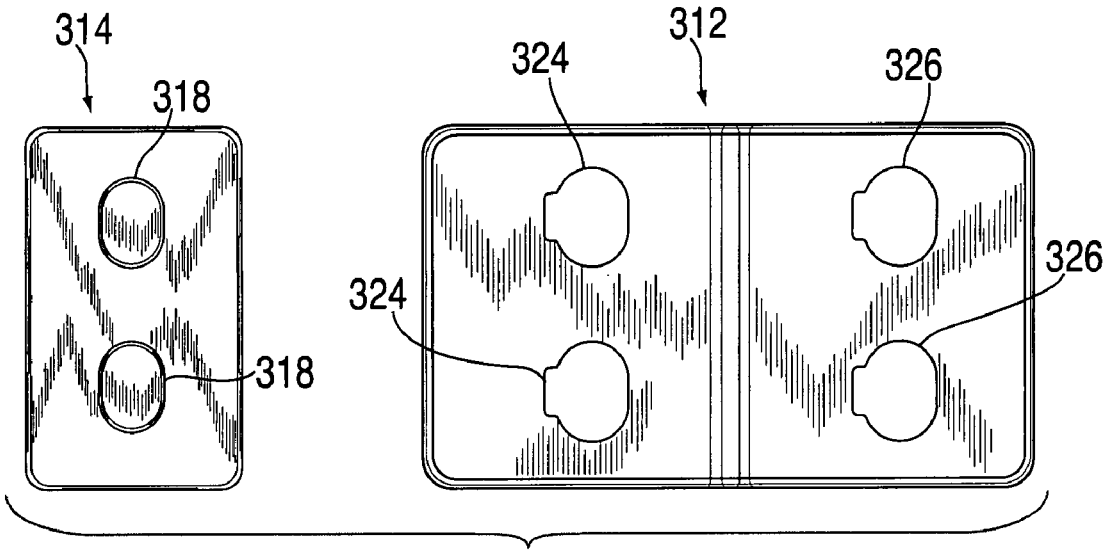
FIG. 16 is a plan view of a fourth embodiment of the male and female fasteners parts.
Figure 17:
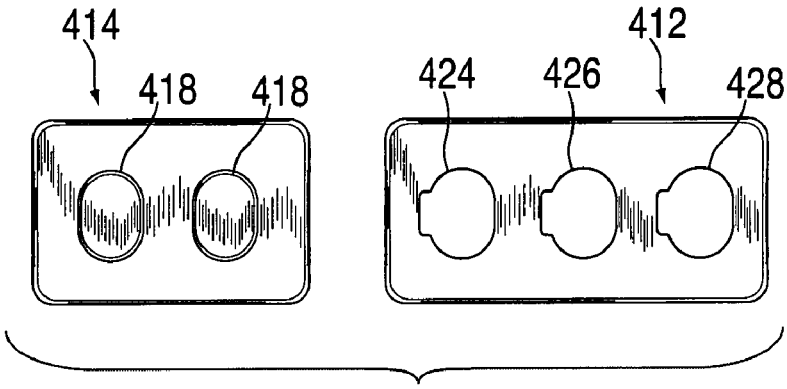
FIG. 17 is a plan view of a fifth embodiment of the male and female fasteners parts.

FIGS. 16 and 17 illustrate other possible arrangements employing multiple male and female fastener parts. FIG. 16 illustrates a male fastener 314 having two side-by-side flanges 318 which are intended to mate with either of two sets of similarly arranged, paired openings 324 or 326 respectively. This "double" fastening arrangement is particularly suitable to provide added support and fastening power for a full figure bra or sports bra.

Similarly, FIG. 17 illustrates a comparable embodiment having a male fastener 414 with two, spaced-apart flanges 418 arranged serially relative to the similarly arranged female fastener 412 having three serially-spaced apart openings 424, 426, and 428; the two male flanges would be coupled to either openings 424 and 426 or 426 and 428, respectively. This embodiment would also be suitable for a sports bra so as to provide better support and fastening power. Of course, other configurations of multiple fasteners are possible and may vary in number to suit a particular application.

There have been described and illustrated herein several embodiments of an adjustable fastener for clothing, especially brassieres. While particular embodiments of the invention have been described, it is not intended that the invention be limited thereto, as it is intended that the invention be as broad in scope as the art will allow and that the specification be read likewise. For example, although the fasteners are preferably made of a suitable plastic which may be attached to the garment ends by sewing, other fastening methods such as ultrasonic welding may be possible. Moreover, while the fasteners are especially intended for use with brassieres, they may be suitable as fasteners for other clothing items. It will therefore be appreciated by those skilled in the art that yet other modifications could be made to the provided invention without deviating from its spirit and scope as claimed.

What is claimed is:

1. An adjustable fastener for an article of clothing, said fastener comprising:

a) a male part having a base, a riser extending from said base, and a flange extending from the riser, said flange and said base having substantially collinear center lines and said riser having a center line which is laterally offset from said substantially collinear center lines; and b) a female part having a plurality of spaced apart openings, each opening having a broad portion and a narrow portion, wherein said flange is dimensioned to pass through said broad portion but not said narrow portion and said riser is dimensioned to slide into said narrow portion.

2. An adjustable fastener as claimed in claim 1, wherein: said female part consists of a single ply of plastic.

3. An adjustable fastener as claimed in claim 1, wherein: said broad portion is substantially oblate circular in shape, and said flange is substantially oblate circular in shape.

4. An adjustable fastener as claimed in claim 1, wherein: said female part has a center fold.

5. An adjustable fastener as claimed in claim 1, wherein: said flange has an inner ramp.

6. An adjustable fastener as claimed in claim 1, wherein: said flange has an inner nub.

7. An adjustable fastener as claimed in claim 6, wherein: said female part has a groove adjacent each narrow portion.

8. An adjustable fastener as claimed in claim 6, wherein: said female part has a bump adjacent each narrow portion.

9. An adjustable fastener as claimed in claim 4, wherein: said center fold forms an angle of approximately 20 degrees.

10. An adjustable fastener as claimed in claim 1, wherein a plurality of said male and female parts are provided.

11. An adjustable fastener for an article of clothing, said fastener comprising:

a) a male part having a base, a riser extending from said base, and a flange extending from the riser; and b) a female part having a plurality of spaced apart openings, each opening having a broad portion and a narrow portion, wherein said flange is dimensioned to pass through said broad portion but not said narrow portion and said riser is dimensioned to slide into said narrow portion, wherein said female part has a fold between two of said spaced apart openings.

12. An adjustable fastener as claimed in claim 11, wherein: said fold defines an angle of approximately 20 degrees.

13. An adjustable fastener as claimed in claim 11, wherein: said female part consists of a single ply of plastic.

14. An adjustable fastener as claimed in claim 11, wherein: said broad portion is substantially oblate circular in shape, and said flange is substantially oblate circular in shape.

15. An adjustable fastener as claimed in claim 11, wherein: said flange has an inner ramp.

16. An adjustable fastener as claimed in claim 11, wherein: said flange has an inner nub.

17. An adjustable fastener as claimed in claim 16, wherein: said female part has a groove adjacent each narrow portion.

18. An adjustable fastener as claimed in claim 16, wherein: said female part has a bump adjacent each narrow portion.

19. An adjustable fastener as claimed in claim 11, wherein: a plurality of said male and female parts are provided.

20. A brassiere, comprising:

a left cup;

a right cup coupled to said left cup;

a left back strap coupled to said left cup and having a first free end;

a right back strap coupled to said right cup and having a second free end;

an adjustable fastener having a) a male part having a base, a riser extending from said base, and a flange extending from the riser, said flange and said base having substantially collinear center lines and said riser having a center line which is laterally offset from said substantially collinear center lines, said male part being coupled to one of said first and second free ends; and b) a female part having a plurality of spaced apart openings, each opening having a broad portion and a narrow portion, wherein said flange is dimensioned to pass through said broad portion but not said narrow portion and said riser is dimensioned to slide into said narrow portion, said female part being coupled to the other of said first and second free ends.

21. A brassiere according to claim 20, wherein: said male and female parts are coupled to said free ends by stitching.

22. A brassiere according to claim 20, wherein: said male and female parts are coupled to said free ends such that when the brassiere is worn, said female part faces the back of the wearer and said male part faces away from the back of the wearer.

23. A brassiere according to claim 20, wherein: said female part is a single ply of plastic.

24. A brassiere according to claim 21, wherein: said base is a single ply of plastic.

25. A brassiere, comprising:

a left cup;

a right cup coupled to said left cup;

a left back strap coupled to said left cup and having a first free end;

a right back strap coupled to said right cup and having a second free end;

an adjustable fastener having a) a male part having a base, a riser extending from said base, and a flange extending from the riser, said male part being coupled to one of said first and second free ends; and b) a female part having a plurality of spaced apart openings, each opening having a broad portion and a narrow portion, wherein said flange is dimensioned to pass through said broad portion but not said narrow portion and said riser is dimensioned to slide into said narrow portion, said female part being coupled to the other of said first and second free ends, and wherein said female part has a fold between two of said spaced apart openings.

26. A brassiere as claimed in claim 25, wherein:

said fold defines an angle of approximately 20 degrees.

27. A brassiere as claimed in claim 23, wherein:

said female part is arranged such that, when said brassiere is worn, said fold forms a concavity that faces the wearer's back.

28. A brassiere as claimed in claim 25, wherein:

a plurality of said male parts are provided.

* * * * *